US006035494A

United States Patent [19]

Duke et al.

[11] Patent Number: 6,035,494

[45] Date of Patent: Mar. 14, 2000

[54] BUTTON

[75] Inventors: Susan Duke, Norrieston, Thornhill, Stirling FK8 3QE Scotland; Bruce Wood, Glasgow, both of United Kingdom

[73] Assignee: Susan Duke, Scotland, United Kingdom

[21] Appl. No.: 09/283,900

[22] Filed: Apr. 1, 1999

[51] Int. Cl.[7] ..... A44B 1/14; A44B 5/00

[52] U.S. Cl. ..... 24/113 R; 24/90.5; 24/113 MP

[58] Field of Search ..... 24/113 MP, 113 R, 24/90.5, 114.9, 92, 93, 104, 107, 108

[56] References Cited

U.S. PATENT DOCUMENTS

| | | | |
|---|---|---|---|
| 1,747,322 | 2/1930 | Riker | 24/113 R |
| 2,577,723 | 12/1951 | Groh | 24/113 R |
| 2,715,253 | 8/1955 | Martin . | |
| 2,776,434 | 1/1957 | Ellestad | 24/113 R |
| 2,906,045 | 9/1959 | Stein | 24/113 R |
| 3,343,230 | 9/1967 | Darvie | 24/113 R |
| 3,777,336 | 12/1973 | Anderson | 24/113 MP |
| 4,471,510 | 9/1984 | Derosa . | |
| 4,907,320 | 3/1990 | Miao . | |
| 4,959,890 | 10/1990 | Pazurek . | |
| 4,969,241 | 11/1990 | Griffin . | |
| 5,315,739 | 5/1994 | Herman . | |
| 5,337,584 | 8/1994 | Angeli | 24/113 R X |
| 5,621,951 | 4/1997 | Gould | 24/90.5 |

FOREIGN PATENT DOCUMENTS

| | | |
|---|---|---|
| 0 113 316 | 7/1984 | European Pat. Off. . |
| 0 209 496 | 5/1986 | European Pat. Off. . |
| 0 209 496 | 1/1987 | European Pat. Off. . |
| 0 528 158 | 2/1993 | European Pat. Off. . |
| 2289-136 | 10/1974 | France . |
| 2 289 136 | 10/1974 | Germany . |
| 3 416 088 | 4/1984 | Germany . |
| 3 614 966 | 5/1986 | Germany . |
| 4118181 | 6/1991 | Germany . |
| 4 118 181 | 12/1992 | Germany . |
| 4 437 956 | 4/1996 | Germany . |
| 18270 | 9/1908 | United Kingdom . |
| 610274 | 4/1946 | United Kingdom . |
| 622990 | 5/1947 | United Kingdom . |
| 972769 | 10/1964 | United Kingdom . |
| 2 252 030 | 1/1991 | United Kingdom . |
| 2 252 030 | 7/1992 | United Kingdom . |
| WO 96/05749 | 2/1996 | WIPO . |

*Primary Examiner*—James R. Brittain
*Assistant Examiner*—Robert J. Sandy
*Attorney, Agent, or Firm*—Alston & Bird LLP

[57] ABSTRACT

A button (10) consists of a base (12) for securing to a garment or the like, and a removable cover (14). The cover defines a pair of resilient arms (22, 24) adapted for releasable engagement with a mounting profile (16) on the rear of the base (12). In a preferred embodiment, the mounting profile (16) and arms (22, 24 are provided with recesses (18) and corresponding projections (26) for secure mounting, and projections (28) enabling the arms to be bent outward in order to release the cover.

19 Claims, 2 Drawing Sheets

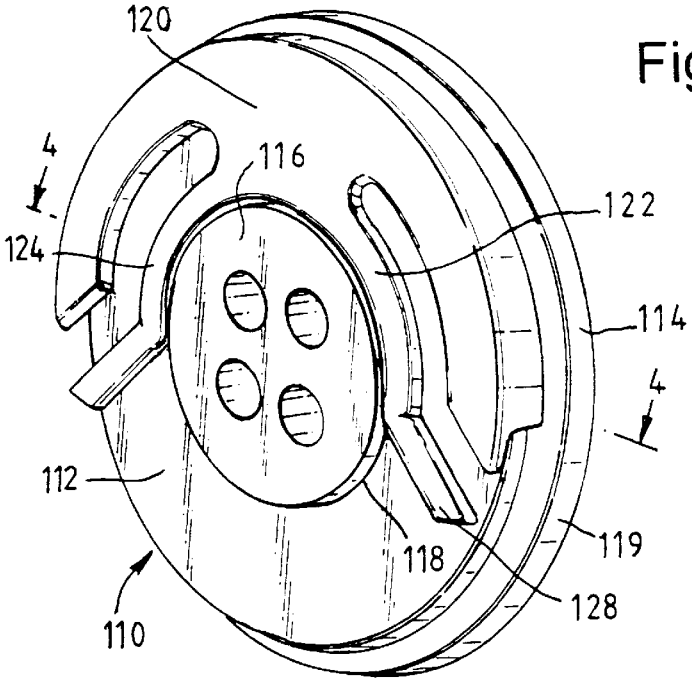
Fig. 3
Fig. 4
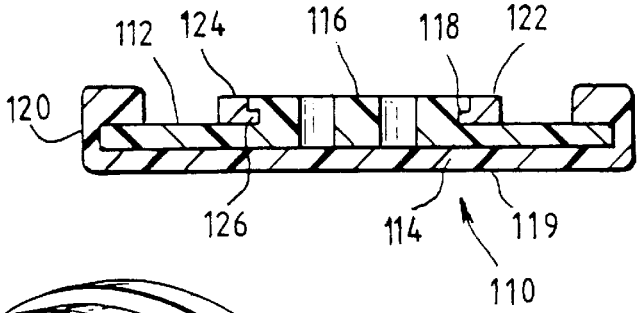
Fig. 5
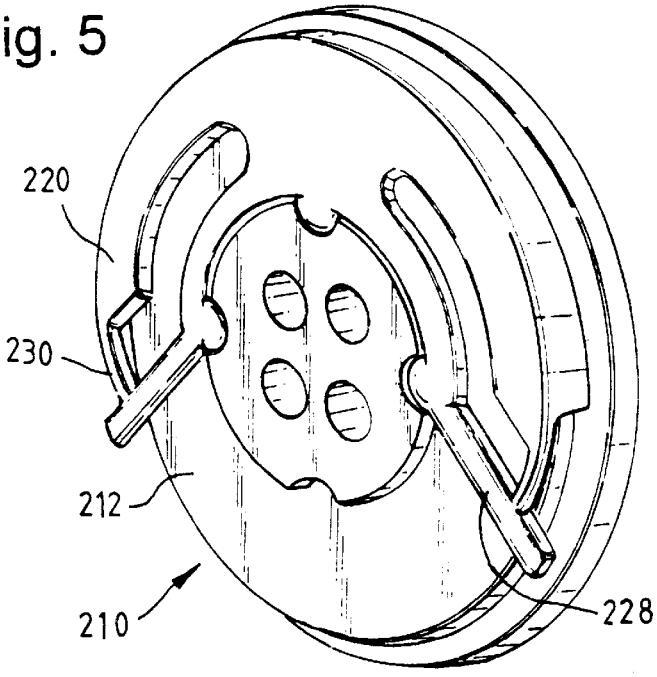

BUTTON

FIELD OF INVENTION

The present invention relates to a button comprising a base for securing to a garment, and a removable cover. The appearance of the button may be varied by replacing one cover with another, or by altering the configuration of the cover relative to the base portion.

SUMMARY OF THE INVENTION

According to the present invention there is provided a button comprising: a base adapted for attachment to a garment and the like, and defining a coupling profile on a rear portion thereof, and a cover adapted to be removably coupled to the base and defining a cover portion adapted to extend over the front of the base and one or more resilient arms adapted for releasable engagement with the coupling profile, wherein the arms of the cover extend substantially parallel to the plane of the cover portion so that, in use, the cover may be coupled and uncoupled from the base by relative lateral movement.

Preferably, the cover is provided with a pair of resilient arms.

Preferably also, the coupling profile extends rearwardly of the base. This ensures that the base is spaced from the garment and facilitates the releasable attachment of the cover to the base. Preferably also, the profile defines retention means for co-operating with the resilient arms of the upper portion to retain the cover on the base. The retention means may take the form of a groove extending around the profile. Alternatively, or in addition, the retention means may take the form of a plurality of peripheral recesses positioned in circumferentially spaced relation to one another.

The resilient arms of the cover are adapted to releasably engage the profile. The resilient arms may be provided with one or more projections which are adapted to engage with corresponding recesses in the profile. Alternatively, or in addition, the resilient arms may define an edge which is adapted to be received within a groove in the profile.

Preferably also, free end portions of the resilient arms extend radially outwardly to facilitate user access to the arms for removal of the cover from the base.

The cover may be coupled to the base by moving the cover laterally in one direction relative to the base so that the resilient arms co-operate and engage with the coupling profile. The cover may be uncoupled from the base by moving the cover laterally relative to the base in the opposite direction. First, however, the resilient arms have to be released from engagement with the profile by a user applied force. In a preferred embodiment, the ends of the resilient arms are moved radially outwards, away from the profile, thereby releasing the arms from engagement with the profile.

Preferably also, the arms of the cover are arranged to partially encircle a perimeter of the profile and engage opposing portions of the profile perimeter. Most preferably, the arms are radially outwardly deflectable to allow engagement with and disengagement from the profile.

Preferably also, the cover defines a lip for location over an edge portion of the base, the lip serving to stabilise the cover on the base. Most preferably, the lip extends around half of the circumference of the base. The resilient arms may be mounted on the lip.

Preferably also, the free end portions of the resilient arms are provided with flexures coupled to the remainder of the base. This provides the arms with greater strength and resilience.

Most preferably, the flexures couple the free end portions to the lip.

The base may be attached to a garment in a conventional manner, for example, by sewing. In one embodiment, the base is provided with two or more apertures extending through the base. Alternatively, a loop or stud may be provided on the base.

The button may comprise two or more interchangeable covers each cover having a different appearance. Thus, the appearance of the button may be altered by replacing one cover with another. Additionally, the appearance of the button may be altered by rotating the cover relative to the base.

The cover may be of a different shape and size to the base. In use, the cover will typically conceal the entirety of the upper surface of the base. However, in certain circumstances, it may be advantageous for portions of the upper surface of the base to remain uncovered. For example, by using a cover that only conceals the perimeter of the base, the appearance of the border of the button may be altered exclusively.

BRIEF DESCRIPTION OF THE DRAWINGS

These and other aspects of the present invention will now be described, by way of example, with reference to the accompanying drawings, in which:

FIG. 3 is a rear view of a button in accordance with a second embodiment of the present invention, and FIG. 4 is a sectional view on line 4—4 of the button of FIG. 3.

FIG. 5 is a rear view of a button in accordance with a third embodiment of the present invention.

DETAILED DESCRIPTION OF THE DRAWINGS

Figure 1:
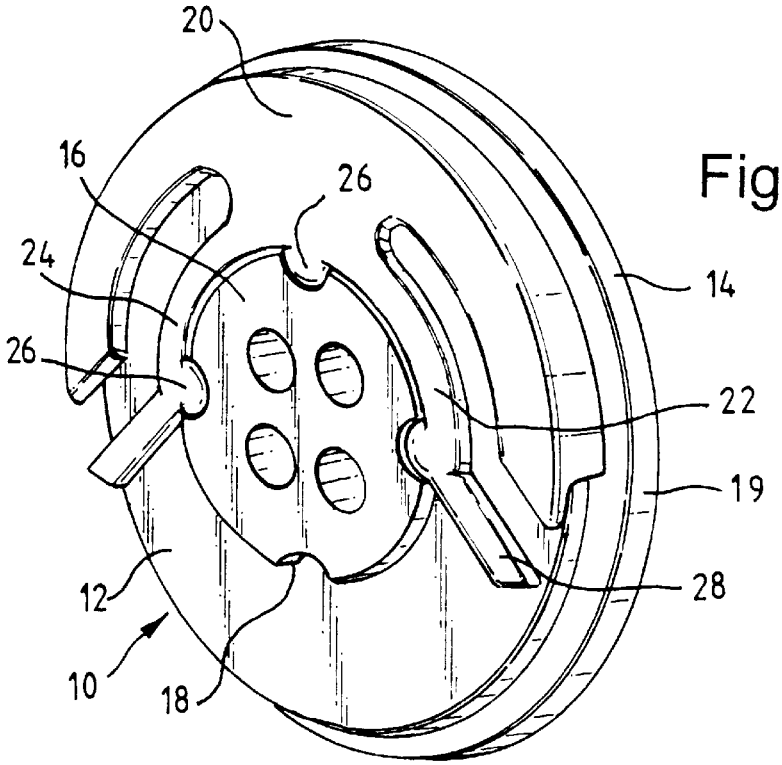
FIG. 1 is a rear view of a button in accordance with a first embodiment of the present invention.
Figure 2:
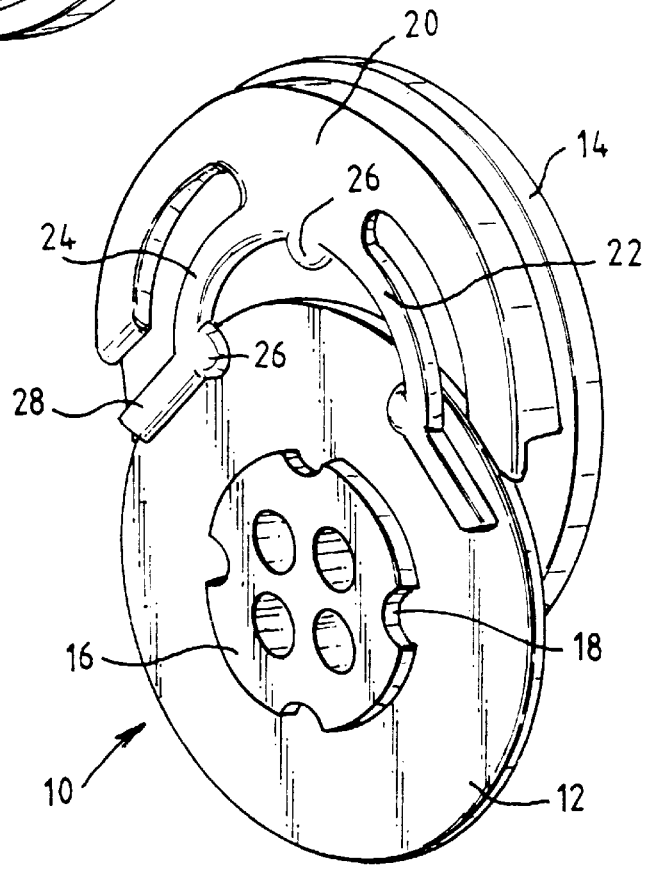
FIG. 2 is an exploded view of the button of FIG. 1.

Reference is first made to FIGS. 1 and 2 of the drawings which depict a button 10 in accordance with a first embodiment of the present invention. The button 10 comprises a base 12 for attachment to a garment (not shown) and a decorative cover 14 which is releasably mountable on the base 12.

The base 12 is provided with four circular apertures and may be attached to a garment by loops of thread in a conventional manner. The apertures extend through a generally circular centrally located profile 16 which protrudes from the rear of the base 12; thus, when the base 12 is attached to a garment, the outer portion of the base 12 is spaced from the garment.

The outer circumference of the profile 16 defines four semi-circular recesses 18 spaced at 90° from one another. These recesses 18 are adapted to receive corresponding portions of the cover 14, as explained below.

The cover 14 defines a cover portion 19 which extends over the front of the base, the front of the cover portion having a decorative appearance. The cover also defines a semi-circular lip 20 for engaging an edge portion of the base 12 and which provides a mounting for a pair of resilient arms 22, 24 for extending rearwardly of the base 12. The arms 22, 24 are configured to partially encircle the profile 16 of the base 12, as shown in FIG. 1. Projections 26 extending from the arms 22, 24 are received within the recesses 18 in the base 12. This arrangement prevents the cover 14 from being inadvertently detached from the base 12.

As may be seen in FIGS. 1 and 2, the free ends 28 of the arms 22, 24 extend radially outwards so that when the cover and base are coupled together, the free ends of the arms extend outwardly of the profile. This configuration facilitates user access for detachment of the cover from the base; by pushing the free ends 28 outwards, a user may disengage the projections 26 from the recesses 18. The cover 14 may then be removed from the base 12 by relative lateral movement of the base and cover.

The appearance of the button 10 may be altered by replacing one decorative cover 14 with another. The appearance of the button 10 may also be varied by rotating the cover 14 by 90°, 180° or 270° relative to the base 12. For example, a cover 14 having a decorative pattern of parallel stripes may be attached to a base so that the stripes are either vertically or horizontally disposed.

Reference is now made to FIGS. 3 and 4 of the drawings which depict a button 110 in accordance with a second embodiment of the present invention. The button 110 comprises a base 112 for attachment to a garment (not shown), and a decorative cover 114 which is releasably mountable on the base 112.

The base 112 is provided with four circular apertures and may be sewn onto a garment by conventional methods.

A profile 116 protrudes from the rear of the base and defines a perimeter groove 118 (FIG. 4). The groove 118 is adapted to receive corresponding portions of the cover 114, as explained below.

The cover 114 defines a cover portion 119 adapted to extend over the front of the base. The upper portion also defines a lip 120, and a pair or resilient arms 122, 124 which are configured to partially encircle the profile 116, as shown in FIG. 3. The arms each define a stepped inner edge 126 which is adapted to fit into the groove 118, as shown in FIG. 4. The free ends 128 of the arms extend radially outwards to facilitate user access for detachment of the cover from the base; by pushing the free ends 128 outwards, a user may disengage the stepped edges from the groove. The cover 114 may then be removed from the base 112 by relative lateral movement of the base and cover.

The appearance of the button 110 may be altered by rotating the cover 114 relative to the base 112. The presence of a single groove 118 allows the cover 114 to be rotated relative to the base 112 without detaching the cover 114 from the base 112. Additionally, the appearance of the button 110 may also be altered by replacing one decorative cover 114 with another.

In a third embodiment, as illustrated in FIG. 5 of the drawings, there are flexures 230 provided between the free ends 228 and the semi-circular lip 220, in order to provide the free ends 228 with greater resilience and resistance to repeated flexing. The free ends 228 extend beyond the edge of the base 212, for ease of access by the user. The button 210 is otherwise identical to the button 10 illustrated in FIGS. 1 and 2.

Although reference has been made primarily herein to mounting buttons on garments, buttons of the present invention may be mounted on, for example draperies, shoes and furniture. The buttons may also be used where there is no intention or requirement to change the cover: the form of button provides a convenient arrangement for mounting a button having a solid or smooth upper surface on a garment using a conventional button fixing arrangement. Further, a button of the present invention may be utilised to provide a badge having an appearance which may be altered by replacing one cover by another; this may be useful on uniforms, allowing individuals to mount an appropriate cover, for example, indicating rank or title, on a base provided on the uniform, rather than pinning a badge to the uniform, which badge will have to be removed for cleaning the uniform and which may also damage the uniform.

Various modifications may be made to the embodiments described above without departing from the scope of protection.

We claim:

1. A button comprising: a base for attachment to a garment, said base having a coupling profile protruding rearwardly from a rear portion thereof, and a cover removably coupled to said base and having a cover portion extending in a plane over a front portion of said base and one or more resilient arms for releasable engagement with said coupling profile, said arms extending substantially parallel to the plane of said cover portion to permit said cover to be coupled and uncoupled from said base by relative lateral movement.

2. A button according to claim 1 wherein said cover defines a pair of resilient arms.

3. A button according to claim 1 wherein two or more apertures extend through the base.

4. A button according to claim 1 wherein said coupling profile defines retention means for co-operating with said resilient arms for retaining said cover on said base.

5. A button according to claim 4 wherein said retention means comprises a groove extending around said coupling profile.

6. A button according to claim 4 wherein said retention means comprises a plurality of peripheral recesses spaced around said coupling profile.

7. A button according to claim 6 wherein said resilient arms comprise one or more projections to engage with said peripheral recesses.

8. A button according to claim 1 wherein said resilient arms comprise free end portions extending radially outwardly of the cover to facilitate user access to said arms for removal of said cover from said base.

9. A button according to claim 8 wherein said free end portions extend beyond an outer edge of said base.

10. A button according to claim 1 wherein free end portions of the arms are movable outwardly, to release said cover from said coupling portion.

11. A button according to claim 1 wherein said resilient arms are arranged to partially encircle a perimeter of said profile and to engage opposing portions of said profile perimeter.

12. A button according to claim 1 wherein said cover defines a lip for location over an edge portion of said base, to stabilise said cover on said base.

13. A button according to claim 12 wherein said lip extends around substantially half of the circumference of said base.

14. A button according to claim 12 wherein said resilient arms are mounted on said lip.

15. A button according to claim 12 wherein said resilient arms comprise flexures coupled between free end portions of the arms and said lip.

16. A button according to claim 1 wherein said resilient arms further comprise flexures between free end portions of the arms and the cover.

17. A button comprising: a base for attachment to a garment, said base having a coupling profile on a rear portion thereof; and a cover removably coupled to said base and having a cover portion extending in a plane over a front portion of said base and one or more resilient arms for releasable engagement with said coupling profile, said arms extending substantially parallel to the plane of said cover portion to permit said cover to be coupled and uncoupled from said base by relative lateral movement, wherein said coupling profile defines a groove extending around said coupling profile for co-operating with said resilient arms for retaining said cover on said base.

18. A button comprising: a base for attachment to a garment, said base having a coupling profile on a rear portion thereof; and a cover removably coupled to said base and having a cover portion extending in a plane over a front portion of said base and one or more resilient arms for releasable engagement with said coupling profile, said arms extending substantially parallel to the plane of said cover portion to permit said cover to be coupled and uncoupled from said base by relative lateral movement, wherein said coupling profile defines a plurality of peripheral recesses spaced around said coupling profile for co-operating with said resilient arms for retaining said cover on said base.

19. A button according to claim 18 wherein said resilient arms comprise one or more projections to engage with said peripheral recesses.

* * * * *